US006089412A

United States Patent [19]

Snell et al.

[11] Patent Number: 6,089,412

[45] Date of Patent: Jul. 18, 2000

[54] MULTIPURPOSE DISPENSER SYSTEM

[75] Inventors: Eric J. Snell, Hatfield; Thomas E. Meacham, Jr., Jamison; Bruce C. Yeagle, Sr., Langhorne, all of Pa.

[73] Assignee: B&G Equipment Company, Plumsteadville, Pa.

[21] Appl. No.: 09/173,800

[22] Filed: Oct. 16, 1998

[51] Int. Cl.[7] ..... B67D 5/42

[52] U.S. Cl. ..... 222/309; 222/214; 222/327; 222/391

[58] Field of Search ..... 222/325, 327, 222/391, 633, 326, 309, 214

[56] References Cited

U.S. PATENT DOCUMENTS

| | | | |
|---|---|---|---|
| 1,377,077 | 5/1921 | Irwin | 222/633 |
| 2,551,676 | 5/1951 | Hoffman | 222/633 X |
| 2,823,487 | 2/1958 | Mandlak | 222/633 X |
| 4,256,241 | 3/1981 | Mesic | 222/85 |
| 5,022,563 | 6/1991 | Marchitto et al. | 222/327 |
| 5,226,567 | 7/1993 | Sansalone | 222/195 |
| 5,289,952 | 3/1994 | Gueret | 222/633 X |
| 5,353,962 | 10/1994 | Scholz et al. | 222/326 X |
| 5,400,925 | 3/1995 | Simmen | 222/326 X |
| 5,743,431 | 4/1998 | Brattesani | 222/326 X |

*Primary Examiner*—Kevin Shaver
*Assistant Examiner*—Thach H. Bui
*Attorney, Agent, or Firm*—Duane, Morris & Heckscher LLP

[57] ABSTRACT

A multipurpose dispenser system including a hand-held dispenser which is capable of dispensing viscous fluid and particulate materials. When dispensing viscous fluids, the dispenser precisely dispenses such materials without wasteful post-extrusion. The system also includes an adaptor for mounting a particulate material dispenser to the dispenser as well as particulate material dispenser cartridges suitable for mounting to the dispenser.

17 Claims, 7 Drawing Sheets

MULTIPURPOSE DISPENSER SYSTEM

FIELD OF THE INVENTION

The present invention relates in general to material dispensing apparatus and in particular to hand-held apparatus for dispensing predetermined quantities of semisolid, viscous liquid or particulate material.

BACKGROUND OF THE INVENTION

A variety of hand-held, manually operated mechanical apparatus are known for selectively dispensing thick, yet flowable semisolid or viscous liquid materials such as gels, pastes, sealants, adhesives, lubricants and caulking materials. Many of these "dispenser gun" apparatus replaceably receive an elongate dispenser tube or cartridge filled with the semisolid or viscous liquid material to be dispensed. The dispenser cartridge typically has a nozzle at its leading end and a piston slidably and substantially sealingly received in its rearward end. Dispenser guns of this sort usually include a handle having a pivotally mounted trigger which may be squeezed by the user to activate piston advancing means. Typical piston advancing means may comprise an elongate rod incrementally advanceable by a pawl and ratchet mechanism linking the rod and the trigger. The forward end of the rod is adapted for contact with the dispenser cartridge piston and incrementally propels the piston as the user squeezes and releases the trigger. As the piston is advanced, semisolid or viscous liquid is discharged from the dispenser tube.

Representative examples of such apparatus include conventional caulk dispensing guns and the Bate Mate™ gel or paste pest bait material dispenser gun marketed by Syrvet, Inc. of Waukee, Iowa. These apparatus include notched or grooved piston advancement rods which are incrementally moved forwardly with each squeeze and release of their triggers. Because their advancement rods can only move forwardly, except when they are deactivated for replacing a spent cartridge with a new cartridge, these apparatus apply continuous pressure against the cartridge piston. Consequently, undesirably "post-extrusion" of excess quantities of semisolid or viscous liquid may occur through the cartridge nozzle following a squeeze and release cycle of the trigger. When using such apparatus considerable care must be exercised to assure that the material being dispensed is neither wasted through post-extrusion nor applied in amounts greater or less than necessary to achieve the intended application objectives.

U.S. Pat. No. 5,022,563 discloses a hand-held dispenser gun which addresses the problem of post-extrusion often encountered when dispensing semisolid or viscous liquid materials. The dispenser gun described therein includes a drive plunger element in the form of an elongate rod for advancing the semisolid or viscous fluid material cartridge piston. The plunger rod has threads, notches or grooves along its length which are adapted for engagement by a spring biased pawl operatively driven by a spring biased, squeezable trigger. In operation, the user squeezes the trigger to advance the plunger rod from a first "at rest" position out of contact with the cartridge piston to a second position where the plunger rod contacts and advances the cartridge piston to dispense a quantity of material from the nozzle of the cartridge. Upon release of the trigger, the gun is designed such that the plunger rod becomes automatically disengaged from the cartridge piston and returns to the first position, thereby relieving the cartridge of pressure that might cause post-extrusion of material from the nozzle.

The pressure relief capability of the dispenser disclosed in U.S. Pat. No. 5,022,563 is useful for meting out controllable quantities of viscous fluid material from the dispenser cartridge. However, the dispenser gun is somewhat cumbersome to use. Specifically, the plunger rod must be manually advanced by physically pushing the rod forwardly in a motion separate from squeezing and releasing the trigger each time the user desires to dispense additional material from the cartridge. In confined, difficult to reach areas, operation of such a gun would be especially onerous.

Additionally, presently existing semisolid and viscous liquid material dispenser guns are capable of dispensing only such materials. In certain situations it would be beneficial for a single dispenser gun to have the capability to dispense not only semisolids and viscous liquids but materials of other physical consistencies such as, for example, powdered, granular or other particulate materials. For instance, pest control professionals often need to dispense semisolid or viscous liquid pest baits and/or granular baits at the same extermination site. Heretofore, these workers have been required to possess an inventory of equipment including at least one apparatus for hand-dispensing semisolid or viscous liquid baits and another for dispensing particulate baits.

An advantage exists, therefore, for a hand-held dispenser which is capable of dispensing semisolid, viscous liquid and particulate materials.

A further advantage exists for a hand-held dispenser which, when dispensing semisolids and viscous liquids, precisely dispenses such material without wasteful post-extrusion by simply squeezing and releasing a trigger movably mounted to the dispenser.

Further advantages exist for an adaptor for mounting a particulate materials dispenser cartridge to a hand-held dispenser as well as particulate material dispenser cartridges suitable for mounting to such a dispenser.

SUMMARY OF THE INVENTION

The present invention provides a multipurpose dispenser system comprising a hand-held dispenser which is capable of dispensing viscous fluids and particulate materials. The dispenser includes a housing, a trigger movably mounted to the housing, and a push rod reciprocally mounted to the housing which is adapted to contact a material dispenser cartridge when the cartridge is mounted to the housing. Squeezing and releasing of the trigger causes respective forward and rearward movement of the push rod whereby material is discharged from the cartridge upon a squeeze of the trigger and its corresponding forward stroke of the push rod. When dispensing viscous fluids, the dispenser precisely dispenses such materials by simply squeezing and releasing the trigger without wasteful post-extrusion because the rearward stroke of the push rod is less than the forward stroke thereof. The system also includes an adaptor for mounting a particulate material dispenser to the dispenser as well as particulate material dispenser cartridges suitable for mounting to the dispenser.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
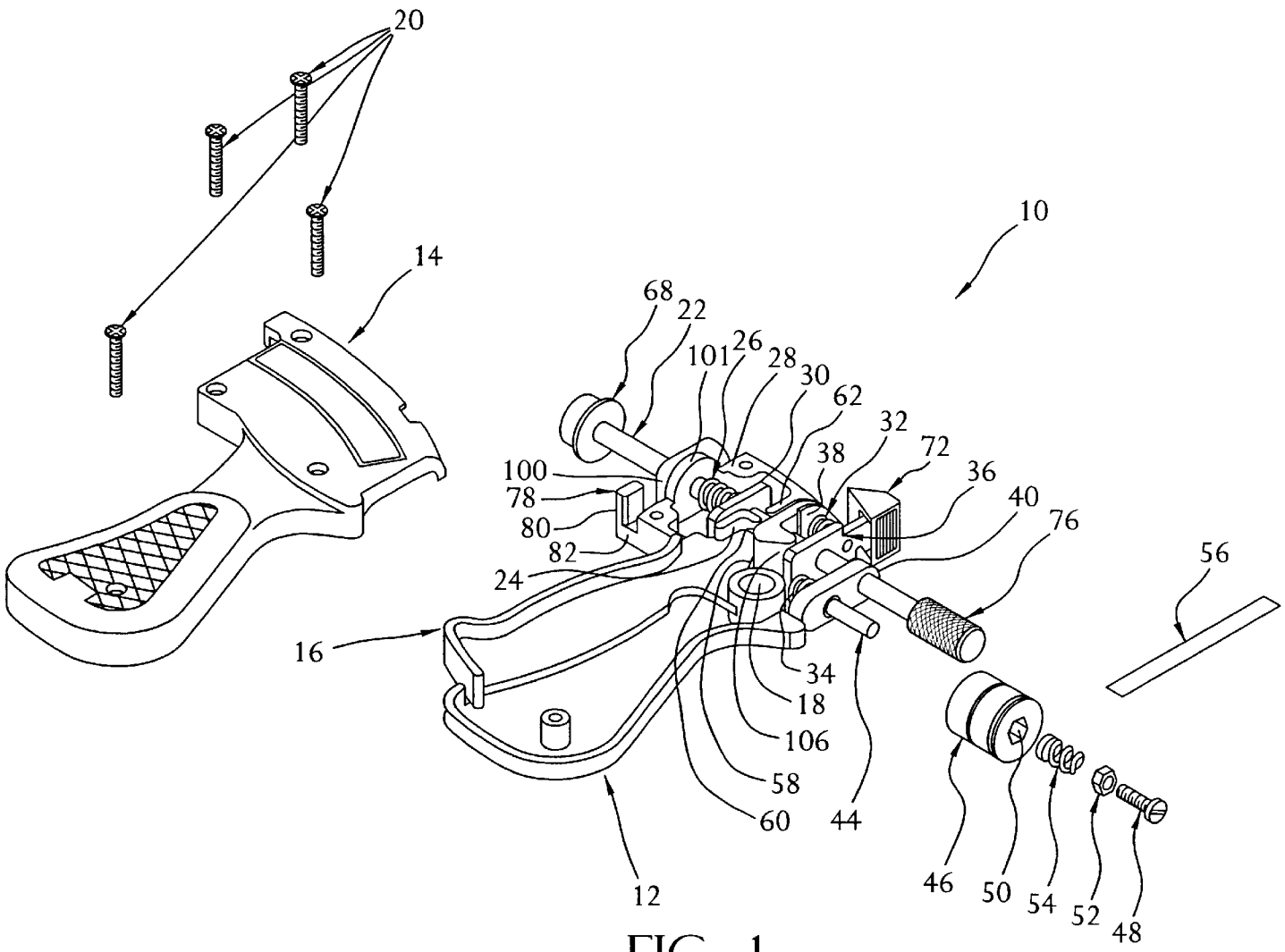
FIG. 1 is an exploded view of a dispenser constructed in accordance with the present invention; parts and their operation.
Figure 2:
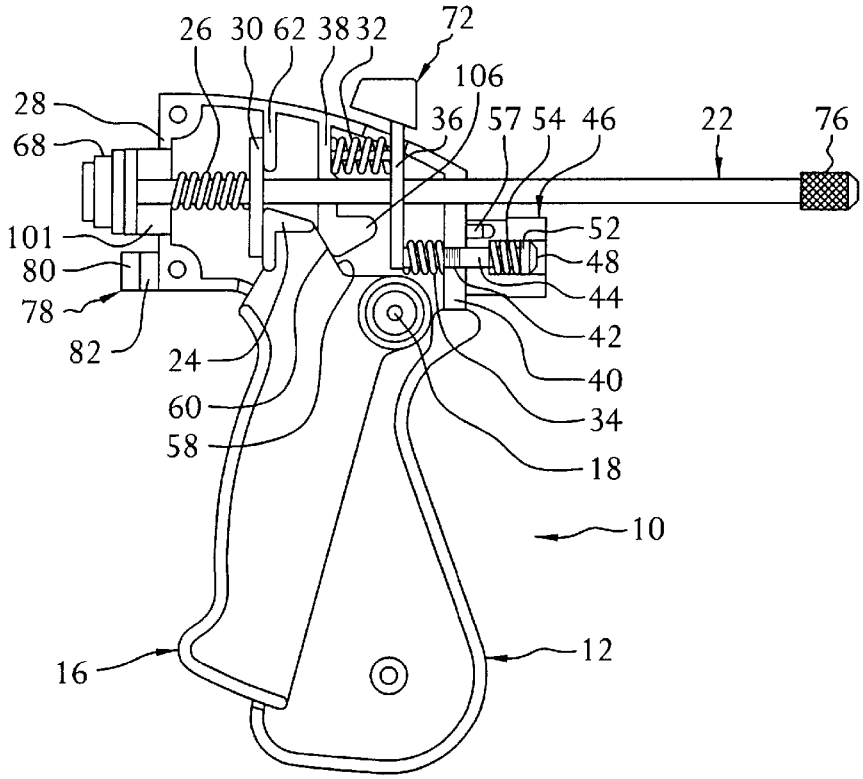
FIG. 2 is a side elevation view of the dispenser of FIG. 1 with the cover thereof omitted to reveal its internal components and with the trigger thereof in an inoperative, unsqueezed position.
Figure 3:
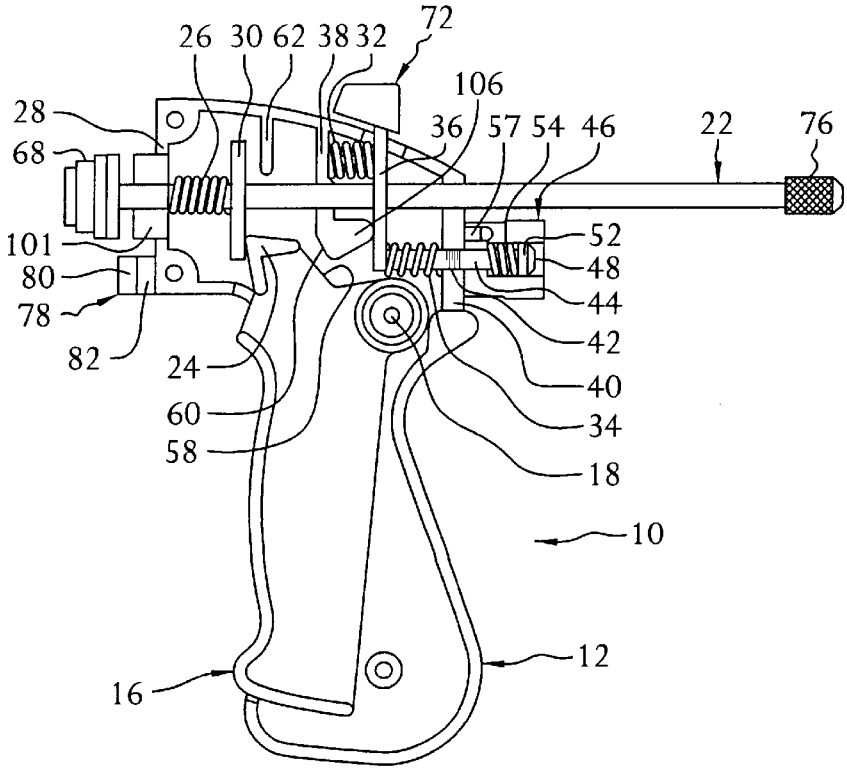
FIG. 3 is a view similar to FIG. 2 with the trigger in fully squeezed position.

Referring to the drawing figures wherein like references indicate similar elements throughout the several views, FIGS. 1, 2 and 3 reveal a material dispenser 10 which comprises a portion of the multipurpose dispenser gun system according to the present invention. Unless otherwise indicated, all elements of dispenser 10 described herein are desirably fabricated from metal or rigid plastic.

Dispenser 10 is preferably constructed as a hand-held gun-type dispenser adapted for fitting in the palm of a user's hand. Dispenser 10 comprises a housing 12, cover 14 and a trigger 16 movably attached to the cover 14 or, as shown, housing 12 at pivot 18. Cover 14 is preferably releasably attachable to housing 12 via removable fastener means 20 such as screws or the like.

The present invention provides, inter alia, means for moving a rigid push rod 22 forwardly and rearwardly to dispense either semisolid/viscous liquid material or particulate material from a dispenser cartridge supported by the dispenser 10. The push rod moving means comprises cam means 24 preferably integrally formed with trigger 16. Unlike push rods employed in conventional viscous fluid material dispensers, the push rod according to the present invention is preferably configured as a smooth, substantially cylindrical member having no ratchet threads, notches or grooves. Similarly, the push rod moving means is preferably free of any pawl or similar ratchet teeth engaging means. According to a presently preferred embodiment, the push rod moving means comprise a plurality of cooperating spring biased lock plates through which push rod 22 is alternatively slidably and grippingly received to effectuate incremental advancement and partial retraction of the push rod during dispensation of semisolid and viscous liquid material (to avoid post-extrusion of such material from a cartridge containing such material) and substantially equivalent advancement and retraction of the push rod during dispensation of particulate material from a cartridge containing such material.

In specific, push rod moving means preferably include a first compression spring 26 disposed about push rod 22 and compressed at its opposite ends between a front wall 28 of housing 12 and a forward lock plate 30. The forward lock plate is provided with an aperture (not shown) of slightly larger diameter than the push rod 22 and within which the push rod is received. As will be described in greater detail hereinafter, the cooperation of spring 26, front lock plate 30 and push rod 22 is such that the push rod may either slide with respect to or be frictionally engaged or clamped by the front lock plate 30 to effectuate incremental advancement or reciprocation of the push rod 22 depending on whether the dispenser gun system according to the invention is configured to dispense semisolid/viscous liquid materials or particulate materials. In this connection, all references hereinafter to "viscous fluid materials" shall be construed to include all flowable semisolid and viscous liquid materials suitable for discharge by the dispenser gun system of the present invention including, without limitation, gels, pastes, sealants, lubricants, adhesives and caulking materials. Similarly, all references hereinafter to "particulate materials" shall be construed to mean, without limitation, dust, powder, granular or similar materials suitable for discharge by the present dispenser gun system.

The push rod moving means further preferably comprise a second compression spring 32 and third compression spring 34 disposed on opposite faces of a rear lock plate 36. The rear lock plate 36, like forward lock plate 30, is provided with an unillustrated aperture of slightly larger diameter than the push rod 22 and within which the push rod is received. As later described in detail, the second and third compression springs 32, 34, the rear lock plate 36 and the push rod 22 cooperate with one another such that the push rod may slide with respect to or be frictionally engaged or clamped by the rear lock plate 30 to incrementally advance or reciprocate the push rod depending on whether the dispenser gun system is configured to dispense viscous fluid or particulate materials.

The second compression spring 32 is compressed at its opposite ends between an intermediate wall 38 of housing 12 and a forward face of rear lock plate 36. To prevent dislodgment of second compression spring 32, at least one of the intermediate wall 38 or forward face of the rear lock plate 36 is provided with a stud (not illustrated) about which one or both ends of the second compression spring may be received.

The third compression spring 34 is compressed at its opposite ends between a rearward face of the rear lock plate 36 and a back wall 40 of housing 12. The front, intermediate and back walls 28, 38 and 40 of housing have collinear apertures of slightly larger diameter than push rod 22 to permit forward and backward movement of the push rod relative to the housing 12. The back wall 40 further preferably includes an internally threaded opening 42 for threadably receiving a forward externally threaded end of a dose adjustment rod 44. The rearward end the dose adjustment rod is preferably externally smooth-walled and internally threaded. A substantially cylindrical dose adjustment knob 46 having an internal bore of sufficient diameter to receive the rearward end of the dose adjustment rod 44 is connected to the dose adjustment rod via screw 48. To prevent rotation of dose adjustment knob 46 relative to dose adjustment rod 44 the rearward end of the internal bore of knob 46 is preferably formed with a polygonal shape 50 (FIG. 1) for receiving a correspondingly sized and shaped nut 52.

In fastening knob 46 to rod 44, a fourth compression spring 54 of suitable length and diameter is inserted in polygonally shaped opening 50 followed by nut 52 and screw 48. The screw 48 is threaded into nut 52 and the rearward end of rod 44. The depth of internal threading within rod 44 should be such that the fourth compression spring 54 is partially but not fully compressed when the screw 48 is fully threaded into the rod 44. By virtue of this arrangement one can quickly and easily set the dispenser 10 to function in either particulate or viscous fluid dispensing modes of operation, as well as dispense differing quantities of viscous fluid material. To do so, the user merely grasps knob 46 and pulls it rearwardly against the force of fourth compression spring 54 and rotates the knob, thereby turning the rod 44 to a desired angular position. The knob 46 is then released whereby the fourth compression spring 54 returns the knob into a newly seated position for enabling the dispenser to dispense either (1) greater or less quantities of viscous fluid, (2) particulate material, if knob 46 was previously in a viscous fluid dispensing setting, or (3) viscous fluid material, if knob 46 was previously in a particulate material setting. To assist the user in selecting the appropriate setting for knob 46, the circumference of the knob 46 may be either permanently marked, painted or etched with suitable indicia, e.g., alphanumeric characters or other symbols. Alternatively, a suitably marked label 56 (FIG. 1) may be permanently or releasably wrapped about the exterior of the knob 46. Optionally, the knob 46 and back wall 40 preferably include cooperating engagement or detachment means such as a pin and socket arrangement 57 (FIGS. 2 and 3) to prevent inadvertent rotation or slippage of the knob 46 from the selected angular setting.

According to a presently preferred embodiment of dispenser 10, the forward end of dose adjustment rod 44 preferably passes through third compression spring 34. The forward or leading tip of rod 44 contacts the rearward face of rear lock plate through at least some or, more preferably, all angular setting positions of the rod 44. In the first inoperative or "at rest" position of FIG. 2, the compressive force of the first compression spring 26 urges the forward lock plate 30 rearwardly such that the rearward face thereof contacts the forward face of cam means 24. To prevent over-pivoting of trigger 16 under the influence of first compression spring 26, an upper rear edge 58 of the trigger is configured to contact a stop surface 60 provided on the intermediate housing wall 38. Additionally, to limit rearward tilting or pivoting of the forward lock plate 30 about push rod 22 under the influence of first compression spring 26 the housing 12 preferably includes a stop 62 extending substantially collinearly with the front face of the cam means 24 when the trigger is in the first inoperative position shown in FIGS. 1 and 2. With the trigger in the inoperative position, the dispenser 10 may be loaded with either a viscous fluid material dispenser cartridge 64 (FIG. 4) or particulate material dispenser cartridge 66 or 66' (FIGS. 6 through 9). To do so, the user must slide the push rod 22 rearwardly until a plunger 68 at the leading end thereof comes to rest against the outer face of the front housing wall 28. However, with trigger 16 in the inoperative first position, the second and third compression springs 32 and 34 exert compressive force against the upper forward face and lower rearward face of the rear lock plate 36 to cause the rear lock plate to tilt or pivot about the push rod 22 to the point where the walls of the push rod opening in the rear lock plate come into gripping or clamping engagement with the upper and lower circumferential regions of the push rod. The rear lock plate 36 preferably has sufficient height such that it projects upwardly through an opening 70 (FIGS. 4, 7 and 8) provided in housing 12. For the user's comfort, the upwardly projecting portion of the rear lock plate is preferably fitted with a button or knob-like actuator 72. When the user wishes to move the push rod 22 rearwardly such as for loading a viscous fluid or particulate material dispenser cartridge onto the dispenser 10, the user presses the rear face 74 of actuator 72 forwardly to compress the second and third compression springs 32 and 34 and thereby release the rear lock plate 36 from clamping engagement with the push rod 22. While maintaining the rear lock plate 36 in this position, the user grasps and slides the push rod rearwardly to the desired extent and then releases actuator 72. To enhance the user's grip of push rod 22, the rear end thereof may be knurled or otherwise textured or it may carry an enlarged, preferably textured, knob as indicated by reference numeral 76. Upon release of actuator 72, the second and third compression springs 32, 34 expand and once again urge the rear locking plate 36 into tilted clamping engagement with the push rod 22.

Protruding from the front wall 28 of housing 12 and/or cover 14 are a plurality of cartridge retention means 78 each defining a retaining finger 80 and stop wall 82. The cartridge retention means 78 desirably correspond in number and angular disposition to the lobes 84 commonly formed at the base 86 of conventional viscous fluid dispenser cartridges such as viscous fluid material dispenser cartridge 64 of FIG. 4 or the lobes 88 formed at the base plate 90 of the particulate material cartridge adaptor 92 shown in FIG. 6 and described hereinafter. To attach viscous fluid dispenser cartridge 64 or the particulate material cartridge adaptor 92, the lobes thereof, either 84 or 88, are brought into alignment with the retention means 78. Thereafter the viscous fluid material dispenser cartridge 64 or particulate material cartridge adaptor 92 are rotated substantially about the longitudinal axis of push rod 22 until their respective mounting lobes pass beneath retaining fingers 80 and seat against stop walls 82. It will be appreciated that opposite rotation will release the viscous fluid material dispenser cartridge 64 or particulate material cartridge adaptor 92 from the retention means 78 when such is desired or necessary. To stabilize the viscous fluid material dispenser cartridge 64 or particulate material cartridge adaptor 92 with respect to the retention means 78, the dispenser 10 preferably includes compressible means 100 (FIGS. 1, 4, 7 and 8) such as a wavy annular spring or the like disposable about a forward projection 101 (FIGS. 1, 2 and 3) of front wall 28.

The operation of the dispenser 10 of the present invention, in a viscous fluid dispensing mode, is as follows.

Figure 4:
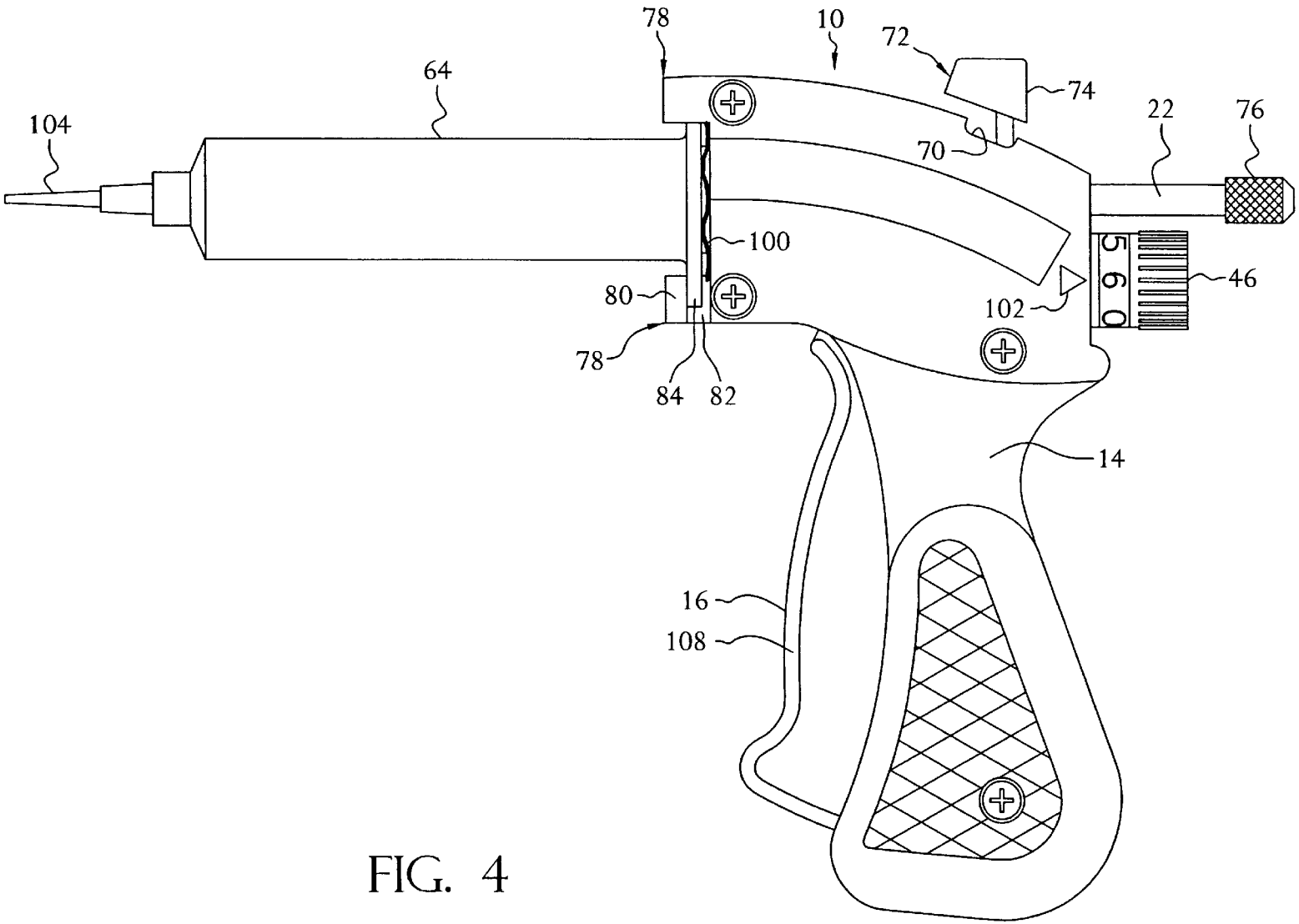
FIG. 4 is a side elevation view of the dispenser of the present invention with a semisolid or viscous material dispenser cartridge mounted thereto.
Figure 5:
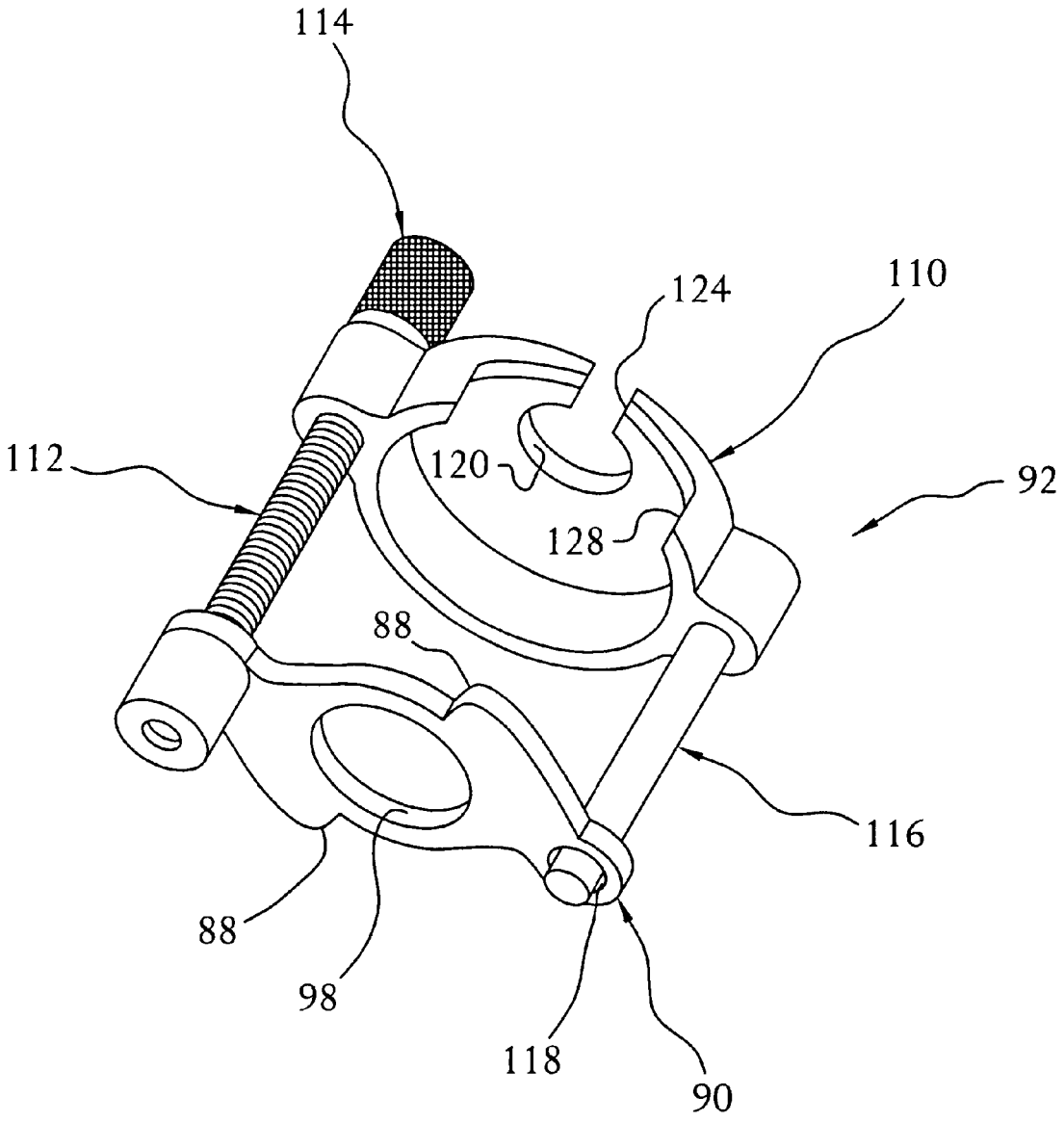
FIG. 5 is a perspective view of a particulate material cartridge adaptor according to the present invention suitable for attachment to the dispenser of FIG. 1.
Figure 6:
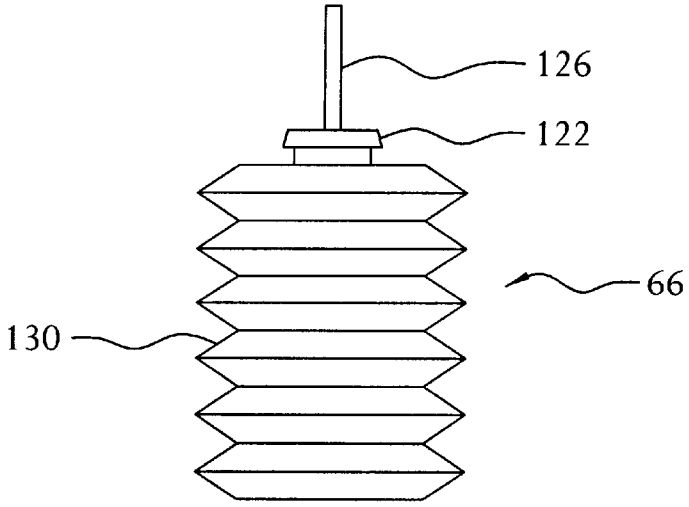
FIG. 6 is an elevation view of a particulate material dispenser cartridge suitable for use in the particulate material cartridge adaptor of FIG. 5.

Initially, the user retracts the push rod 22 and loads a viscous fluid dispenser cartridge 64 to the dispenser 10 as described above. The user then rotates dose adjustment knob 46 to a desired viscous fluid dispensing setting in alignment with a marker 102 provided on housing 12 or, as illustrated in FIGS. 4, 5 and 6, cover 14. Several of the objects and advantages of the present invention may be achieved with a single viscous fluid material setting and a single particulate material setting. However, according to a presently preferred construction, dispenser 10 is capable of dispensing a range of quantities or volumes of viscous material per squeeze of trigger 16. This range may be reflected, for instance, by a series of alphanumeric characters or other symbols (e.g., "1" through "6") provided on the circumference of knob 46, which characters or symbols reflect relatively greater or lesser quantities of viscous material to be dispensed from the nozzle 104 of cartridge 64 each time trigger 16 is squeezed and released.

After choosing the desired setting of dose adjustment knob 46, the user begins squeezing and releasing trigger 16 to incrementally advance plunger 68 against an unillustrated piston slidably and substantially sealingly received within cartridge 64 to dispense viscous fluid from nozzle 104. With each squeeze and release of trigger 16, the components of the push rod moving means cooperate to advance the push rod 22 in stepwise fashion yet also relieve pressure exerted against the piston of cartridge 64 to prevent post-extrusion of the viscous fluid from the cartridge.

More specifically, from the first inoperative position shown in FIGS. 1 and 2, the trigger 16 is squeezed whereupon it begins to rotate about pivot 18 and produce corresponding movement of cam means 24. The moving cam means 24 causes tilting or rotation of the front lock plate 30 into tilted clamping engagement with push rod 22. Concurrently, second and third compression springs 32, 34 also urge the rear lock plate 36 into tilted clamping engagement with the push rod. Continued squeezing of the trigger 16 causes the front lock plate 30 to be separated from contact with stop 62 against the urging of first compression spring 26 thereby resulting in forward movement of the clamped push rod 22. As squeezing of the trigger 16 continues so does the movement of push rod under the clamping influence of the front and rear lock plates 30 and 36. Eventually, the forward face of the rear lock plate 36 contacts a rearward projection 106 of intermediate housing wall 38 at which point forward movement of the rear lock plate ceases. Continued trigger squeezing after this point causes the cam means 24 to continue to urge the front lock plate 30 and push rod 22 forwardly. In so doing, the front lock plate, which is the only lock plate still in clamping engagement with the push rod 22 following contact of the rear lock plate 36 with the rearward projection 106 of the rear lock plate 36, causes the push rod to be pulled through the rear lock plate. Squeezing of trigger 16 and attendant advancement of push rod 22 may thereafter continue until a raised stop ridge 108 of trigger 16 comes into contact with either or both of housing 12 and cover 14 (i.e., the fully squeezed trigger position shown in FIGS. 3 and 8 ) or some other suitable stop means prevents further forward pivoting of the trigger. At this point, the push rod 22 and its plunger 68 are fully extended and the desired quantity of viscous fluid will have been dispensed from the nozzle 104 of cartridge 64.

The user then begins to release the trigger 16. As this occurs, the first lock plate 30 temporarily remains in gripping contact with the push rod 22 and is urged rearwardly by the expansion of the first compression spring 26. Simultaneously, the rear lock plate 36 separates from contact with the rearward projection 106 of the intermediate housing wall 38 and clampingly engages the push rod 22. Continued release of the trigger causes the first and second compression springs 26 and 32 (the latter of which preferably has a greater spring constant than the third compression spring 34) to rearwardly move the front and rear lock plates 30, 36 and the push rod 22 clamped thereby. Such movement continues until the rearward face of the rear lock plate 36 comes into contact with the forward or leading tip of dose adjustment rod 44 thereby arresting further rearward movement of the rear lock plate. At this point, the push rod 22 remains clamped by the rear lock plate 36, which clamping is enhanced by the abutment of the leading tip of the dose adjustment knob 44 with the rear clamp plate. Indeed, upon contact of the rear clamp plate 36 with the dose adjustment knob 44, the rod clamping force exerted by the rear clamp plate exceeds that of the front clamp plate 30 and further rearward movement of the push rod 22 is arrested. Hence, continued release of the trigger 16 and retraction of the cam means 24 enables rearward movement of the front lock plate 30 under the urging of the first compression spring 26 until the front lock plate comes to rest against the stop 62, at which point the trigger reassumes its inoperative position against stop surface 60.

Advancement and retraction of push rod 22 in a viscous fluid dispensing mode of operation is thus determined by the relative displacements of the front and rear lock plates 30 and 36 during squeezing and releasing of the trigger 16. When squeezing the trigger to advance the push rod 22, front lock plate 30 is in dominant clamping engagement with the push rod. Conversely, the rear lock plate 36 is in dominant clamping engagement with the push rod once the rear lock plate comes into contact with the leading tip of the dose adjustment rod 44. To assure that the push rod 22 is incrementally advanced as a result of a complete squeeze and release cycle of trigger 16, the forward displacement of the front lock plate 30 is greater than the rearward displacement of the rear lock plate 36 at any viscous fluid dispensing setting of dose adjustment knob 46, which rearward displacement is established by separation of the rear lock plate 36 from the intermediate housing wall 38 and contact of the rear lock plate 36 with the dose adjustment rod 44. As presently constructed, the lesser the rearward displacement of the rear lock plate 36 during release of trigger 16, i.e., the more deeply dose adjustment rod 44 is threaded into housing 12, the greater the quantity of viscous fluid that is dispensed from cartridge 64.

At all viscous fluid dispensing settings of dose adjustment knob 46, retraction of trigger 16 to its first inoperative position causes the plunger 68 of the push rod 22 to separate from the piston within cartridge 64. Regardless of the setting of knob 46, this separation distance is preferably sufficient to relieve pressure within the cartridge which might otherwise cause post-extrusion of viscous fluid through nozzle 104. Moreover, in a viscous fluid dispensing mode of operation of dispenser 10, the push rod moving means according to the present invention advances the push rod 22 by simply squeezing and releasing the trigger 16; no separate manual manipulation of the push rod is necessary.

Figure 7:
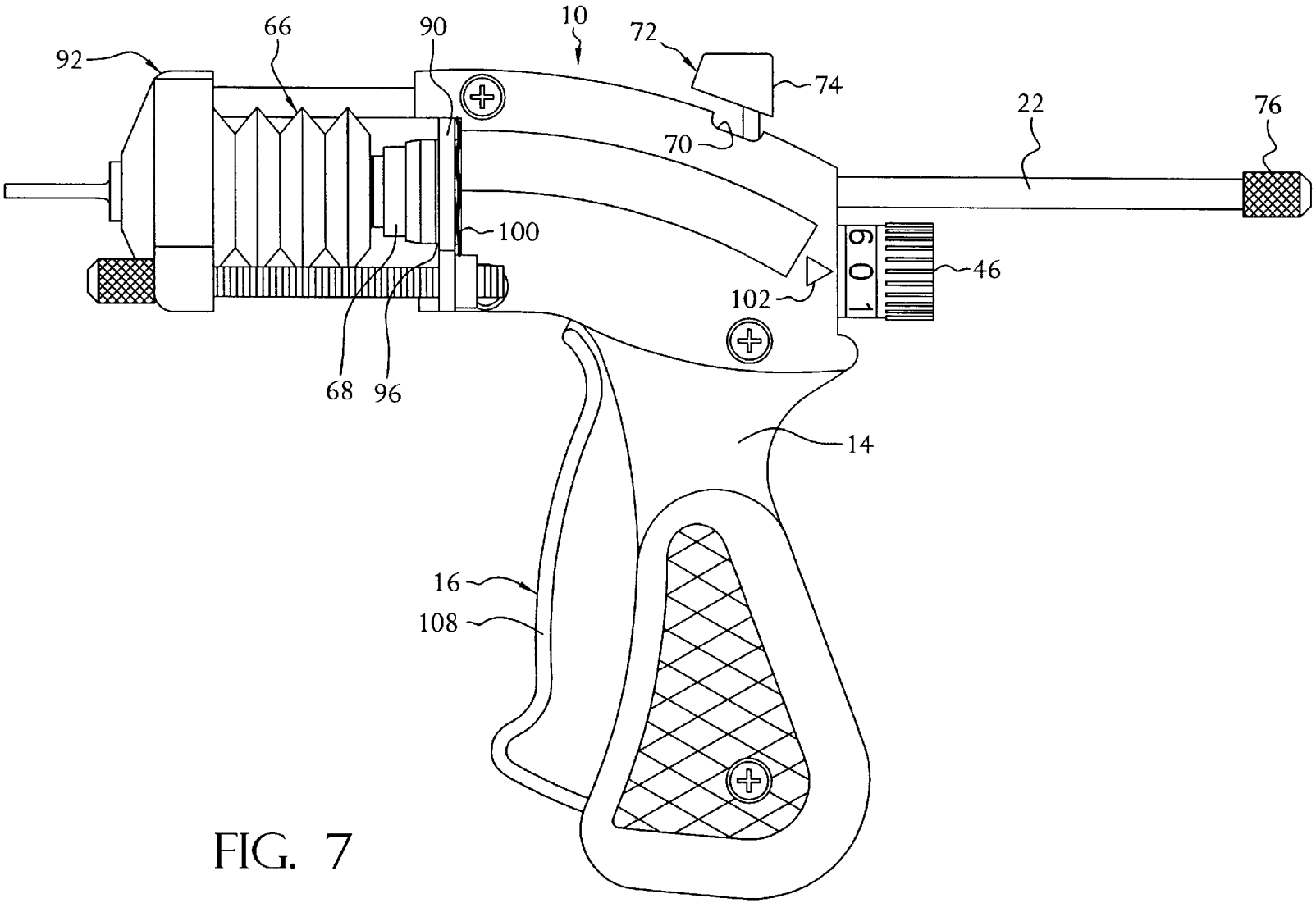
FIG. 7 is a view similar to FIG. 4 of a particulate material cartridge of FIG. 6 received within the adaptor therefor shown in FIG. 5 when the adaptor is mounted to the dispenser of FIG. 1 and the dispenser trigger is in an inoperative first position.
Figure 8:
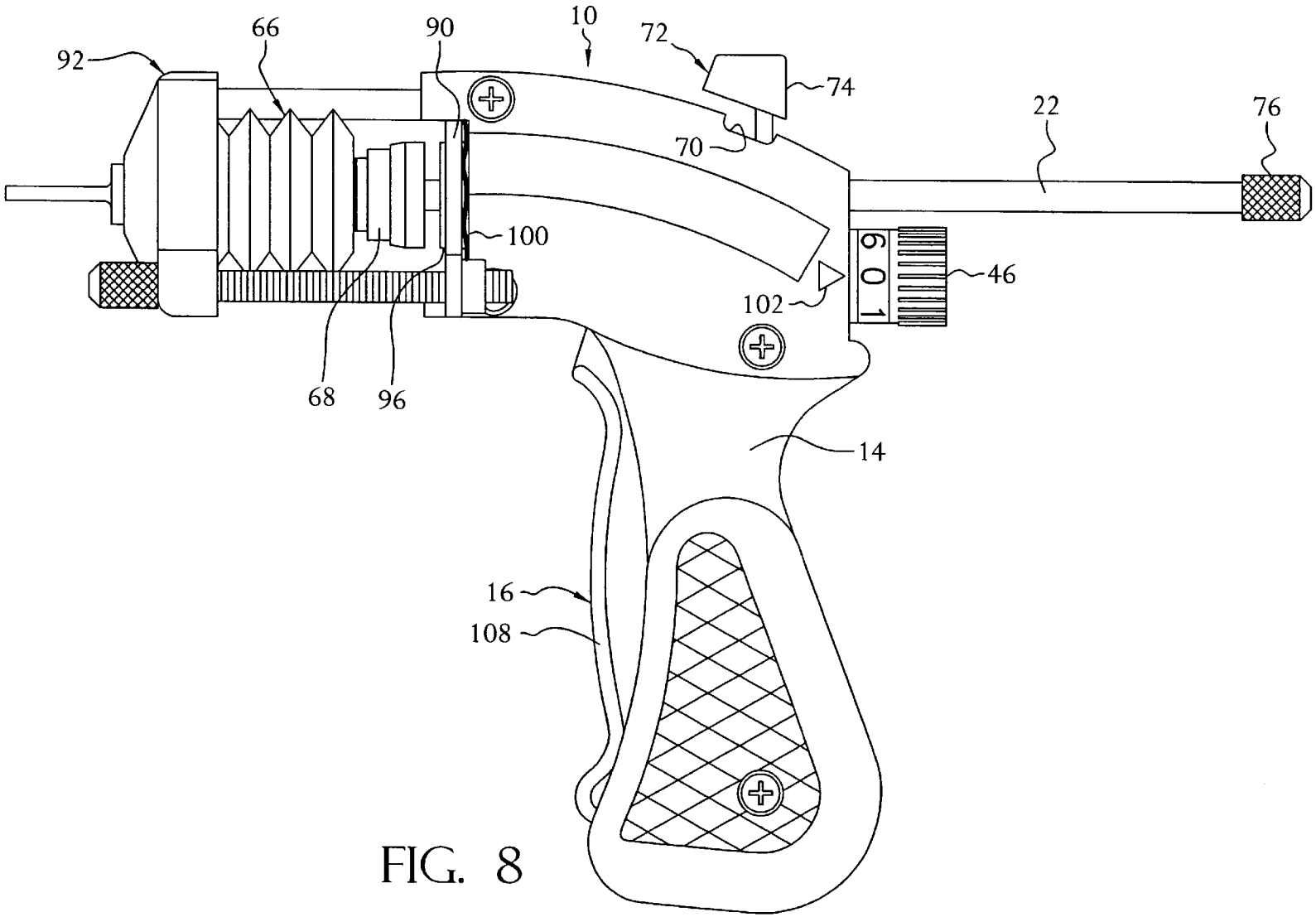
FIG. 8 is a view similar to FIG. 7 wherein the dispenser trigger is disposed in an operative second position.

FIGS. 5 through 9 reveal additional dispensing components, which enable dispenser 10 to dispense particulate materials in addition to viscous fluids. Referring initially to FIG. 5, there is depicted a particulate material cartridge adaptor 92 adapted for receiving a particulate material dispenser cartridge 66 (FIGS. 6, 7, and 8) and releasably connecting same to the retention means 78 of dispenser 10. As mentioned previously, adaptor 92 comprises a base plate 90 having lobes 88 formed therein adapted to cooperate with the retaining fingers 80 of retention means 78 and an opening 98 for receiving a protrusion 96 located at the front wall 28 of dispenser housing 12 (FIGS. 1, 7 and 8). In addition to base plate 90, adaptor 92 preferably comprises a cap member 110 adjustably connected to base plate 90 by a threaded adjustment rod 112 rotatably received within the cap member 110 and threadably received within the base plate 90, or vice versa. To facilitate turning thereof threaded rod 112 preferably includes a knurled or otherwise textured knob 114. Adaptor 92 further preferably includes an alignment rod 116 disposed substantially parallel to adjustment rod 112. Adjustment rod may be carried by cap member 110 and may slide through a cooperating opening 118 provided in base plate 90 to maintain alignment of the cap member as it is moved toward or away from the base plate. It will be understood that alignment rod 116 may alternatively be carried by base plate 90 and its cooperating opening 118 may be provided in cap member 110.

Cap member 110 further includes a central opening 120 of a size suitable to accommodate the neck 122 of particulate material dispenser cartridge 66 (FIG. 6). To facilitate insertion of cartridge 66 into adaptor 92, the cap member may also include a radial slot 124 to accommodate the nozzle 126 of cartridge 66 and a notch 128 adapted to accommodate the body 130 of cartridge 66 (FIG. 6 ). To insert cartridge 66 in adaptor 92, the threaded adjustment rod 112 is unthreaded a distance sufficient to enable the cartridge to be laterally introduced into the adaptor between rods 112 and 116. Thereafter, the user grasps and rotates knob 114 to firmly but not tightly retain the cartridge between the base plate 90 and cap member 110. With the cartridge 66 received in the adaptor 92, the lobes 88 of the base plate 90 may then be twisted into engagement with retention means 78 to mount the adaptor/cartridge assembly onto dispenser 10 as shown in FIGS. 7 and 8.

According to a presently preferred construction illustrated in FIG. 6, particulate material dispenser cartridge 66 comprises a thin-walled, resilient, bellows-type body 130 connected to nozzle 126 at neck 122. Nozzle 126 may be permanently connected to the body 130 whereby the cartridge 66 is discarded after discharge of its particulate contents. Alternatively, nozzle 126 may be detachable whereby the cartridge 66 may be repeatedly refilled and reused. Suitable materials for forming cartridge 66 include low density polyethylene (LDPE)and similar resilient plastics.

The operation of dispenser 10 in a particulate material dispensing mode is as follows.

As when preparing to dispense viscous fluid, the user initially retracts the push rod 22. Then the user selects either particulate material dispenser cartridge 66 (mounted in adaptor 92) or later described cartridge 66' (FIG. 9) and attaches either cartridge to the dispenser as previously described. The user then rotates dose adjustment knob 46 to a particulate material dispensing, e.g., numeral zero (0), in alignment with marker 102 as shown in FIGS. 7 and 8.

After choosing the desired setting of dose adjustment knob 46, the user begins squeezing and releasing trigger 16 to dispense airborne particulate material from cartridge 66 or 66'. With each squeeze and release of trigger 16, the components of the push rod moving means cooperate to advance and retract the push rod and plunger 68. The advancement stroke of push rod 22 (FIG. 8) causes compression of the resilient body 130 or 130'of cartridge 66 or 66' to discharge a burst of pressurized air and particulate material through nozzle 126 or 126'. The retraction stroke of push rod 22 allows the resilient body to expand and draw in air through nozzle 126 or 126' to be used as a propellant medium for the particulate material in the next subsequent squeeze of trigger 16.

More particularly, from the first inoperative position shown in FIG. 7, the trigger 16 is squeezed whereupon it begins to rotate about pivot 18 and produce corresponding movement of cam means 24. The moving cam means 24 causes tilting or rotation of the front lock plate 30 into tilted clamping engagement with push rod 22. Concurrently, second and third compression springs 32, 34 also urge the rear lock plate 36 into tilted clamping engagement with the push rod. Continued squeezing of the trigger 16 causes the front lock plate 30 to be separated from contact with stop 62 against the urging of first compression spring 26 thereby resulting in forward movement of the clamped push rod 22. As squeezing of the trigger 16 continues so does the movement of push rod under the clamping influence of the front and rear lock plates 30 and 36. Squeezing of trigger 16 and attendant advancement of push rod 22 may thereafter continue until a raised a stop ridge 108 of trigger 16 comes into contact with either or both of housing 12 and cover 14 (i.e., the trigger position shown in FIG. 8) or some other suitable stop means prevents further forward pivoting of the trigger. At this point, the push rod 22 and its plunger 68 are fully extended and the desired quantity of particulate material will have been dispensed from the nozzle 104 of cartridge 66 or 66'.

Unlike during dispensation of viscous fluid materials, however, forward movement of the rear lock plate 36 is not stopped by contact with intermediate housing wall 38 during advancement of the push rod 22. When knob 46 is in a particulate material dispensing setting, the dose adjustment 44 is retracted from gun 10 to an extent that the forward displacement of the front lock plate 30 through a complete squeeze of trigger 18 is no greater than the forward displacement of rear lock plate 36. Hence, both lock plates 30, 36 remain in locking engagement with the push rod 22 throughout a squeeze and release cycle of trigger 16. When squeezing the trigger 16 the push rod 22 is advanced from its first inoperative position (FIG. 7) to its second operative position (FIG. 8). When releasing the trigger, the push rod is thus retracted from its second operative position to its first inoperative position.

Greater or lesser amounts of material dispensation through cartridges 66 or 66' may be achieved by selectively controlling the speed or intensity of the trigger squeezing sequence. And, as cartridge 66 becomes depleted of particulate material, threaded adjustment rod 112 may be tightened to reduce the volume of the cartridge to compensation for the discharged volume of particulate material.

Figure 9:
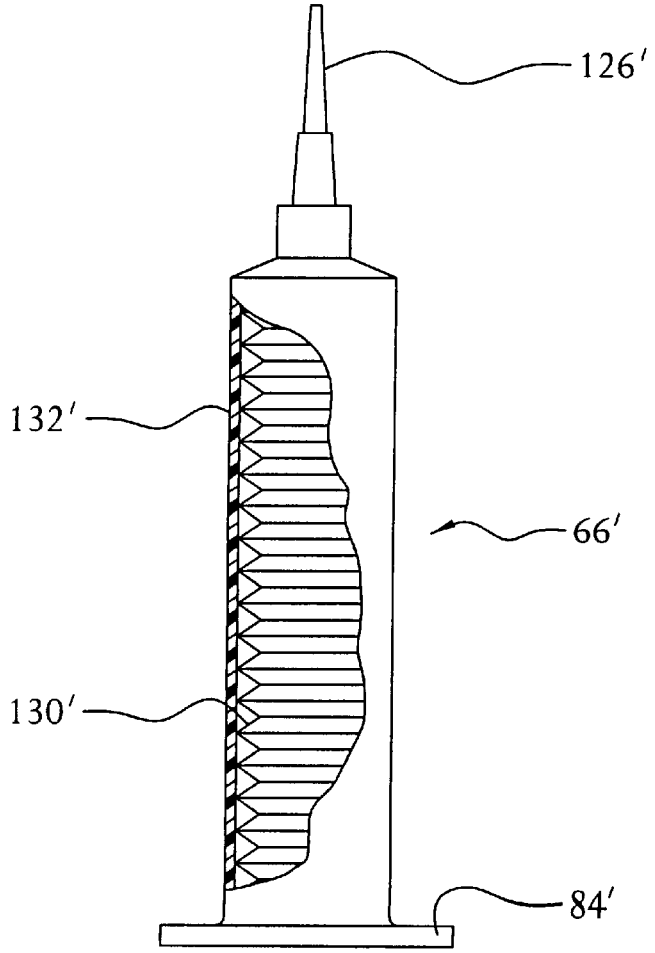
FIG. 9 is an elevation view of a further embodiment of a particulate material dispenser cartridge suitable for use in the dispenser of the present invention.

FIG. 9 reveals an alternative embodiment of a articulate material dispenser cartridge 66' suitable for use with dispenser 10 of the present invention. Cartridge 66' preferably comprises an outer, open-bottomed, tubular sheath 132' fabricated from metal or rigid plastic and having dimensions and structural features similar to viscous fluid material dispenser cartridge 64 discussed above. For instance, sheath 132' preferably includes lobes 84' at its base which are suitable for releasable engagement with retention means 78 of dispenser gun 10. Cartridge 66' further comprises a thin walled, resilient, bellows-type sheath 130' for containing particulate material slidably disposed within sheath 132'. Body 130', like body 130 of cartridge 64, may be formed from any suitable materials including LDPE and the like.

Body 130' may be attached at or substantially near the upper end of sheath 132' such that the majority of the body 130' is slidable with respect to the sheath 132'. Alternatively, sheath 132' may have an inwardly directed lip or flange at its upper end for preventing forward dislodgement of the body 130' from the sheath 132'. So constructed, the body 130' may be easily removed and replaced with a new body when such is desired or necessary. Additionally, as with cartridge 66, the nozzle 126' may be permanently or releasably attached to body 130' at neck 122'.

Cartridge 66' is operated at the same particulate aterial discharge setting of knob 46 as cartridge 66. Unlike artridge 66, however, as cartridge 66 becomes depleted the user simply presses the rear face 74 of actuator 72 and advances push rod and 22 and plunger 68 to compress the inner body 130' a desired degree to compensate for the loss of particulates.

The present invention thus provides a versatile multipurpose dispenser gun system including a dispenser, dispenser cartridges and adaptor means capable of dispensing viscous fluid and particulate materials in a convenient, reliable and precise fashion.

Although the invention has been described in detail for the purpose of illustration, it is to be understood that such detail is solely for that purpose and that variations can be made therein by those skilled in the art without departing from the spirit and scope of the invention except as it may be limited by the claims. For instance, rather than a pivoting trigger 16, dispenser 10 may include an operating trigger capable of other motions, e.g., reciprocation, so long as proper motivation of the lock plate 30 is preserved.

What is claimed is:

1. A material dispenser comprising:

a housing;

means for releasably mounting a material dispenser artridge to said housing;

an elongate push rod slidably movable with respect to said housing, said push rod having first and second ends, said first end being operable to contact a material dispenser cartridge when a material dispenser cartridge is mounted to said housing for urging discharge of material from the cartridge;

push rod moving means operably connected to said trigger and operatively connected to said push rod for moving said push rod forwardly and rearwardly with respect to said housing responsive to squeezing and releasing of said trigger by a user; and adjustment means for selectively disposing said push rod moving means into a particulate material dispensing mode of operation and at least one viscous fluid material dispensing mode of operation.

2. The dispenser of claim 1 wherein said push rod is a smooth, substantially cylindrical member.

3. The dispenser of claim 1 wherein said push rod moving means comprise a first lock plate disposed about said push rod, said first lock plate being operably driven by said trigger to clampingly engage said push rod during the entirety of at least one of a complete squeeze and a complete release of said trigger.

4. The dispenser of claim 3 wherein said push rod moving means further comprise a second lock plate disposed about said push rod, said second lock plate clampingly engaging said push rod during the entirety of at least one of a complete squeeze and a complete release of said trigger.

5. The dispenser of claim 4 wherein, when said push rod moving means is in said particulate material dispensing mode of operation, forward and rearward displacements of said first and second lock plates are substantially equal through a complete squeeze and a complete release, respectively, of said trigger.

6. The dispenser of claim 4 wherein, when said push rod moving means is in said at least one viscous fluid material dispensing mode of operation, forward displacement of said first lock plate through a complete squeeze of said trigger is greater than the rearward displacement of said second lock plate through a complete release of said trigger.

7. The dispenser of claim 4 wherein said adjustment means comprises a threaded rod threadably received in said housing and having a leading tip operable to contact said second lock plate, said threaded rod being selectively rotatable to cause said second plate to assume a first position suitable to effectuate said particulate material dispensing mode of operation and at least one second position suitable to effectuate said at least one viscous fluid material dispensing mode of operation.

8. A particulate material dispenser comprising:

a housing;

means for releasably mounting a particulate material dispenser cartridge to said housing;

an elongate push rod slidably movable with respect to said housing, said push rod having first and second ends, said first end being operable to contact a particulate material dispenser cartridge when a particulate material dispenser cartridge is mounted to said housing for urging discharge of particulate material from the cartridge; and push rod moving means operably connected to said trigger and operatively connected to said push rod for moving said push rod through substantially equal forward and rearward displacements upon a complete squeeze and a complete release, respectively, of said trigger by a user.

9. The dispenser of claim 8 wherein said push rod is a smooth, substantially cylindrical member.

10. A material dispenser system comprising:

a dispenser comprising:

a housing;

means for releasably mounting a first material dispenser cartridge to said housing;

a movable trigger projecting from said housing;

an elongate push rod slidably movable with respect to said housing, said push rod having first and second ends, said first end being operable to contact a first material dispenser cartridge when a first material dispenser cartridge is mounted to said housing; and push rod moving means operably connected to said trigger and operatively connected to said push rod for moving said push rod with respect to said housing to discharge a first material from a first material dispenser cartridge when a first material dispenser cartridge is mounted to said housing; and adaptor means for mounting a second material dispenser cartridge to said means for releasably mounting, said second material discharge cartridge being adapted to contain a second material of a different physical consistency than said first material, said adaptor means comprising:

a base plate including means for engaging said means for releasably mounting and an opening for receiving said first end of said push rod;

a cap member including an opening for receiving a nozzle of a second material dispenser cartridge; and means for adjusting the relative positions of said base plate and said cap member.

11. The system of claim 10 wherein said first material is viscous fluid material and said second material is particulate material.

12. The system of claim 10 wherein said means for adjusting comprise a threaded rod rotatably received in one of said base plate and said cap member and threadably received in the other of said base plate and said cap member.

13. The system of claim 12 wherein said means for adjusting further comprise an alignment rod extending substantially parallel to said threaded rod and carried by one of said base plate and said cap member and received in an opening therefor provided in the other of said base plate and said cap member.

14. The system of claim 10 wherein said push rod is a smooth, substantially cylindrical member.

15. An adaptor for mounting a particulate material dispenser cartridge to a viscous fluid dispenser having a housing, means for releasably mounting a viscous fluid material dispenser cartridge to the housing, a movable trigger projecting from the housing, and an elongate push rod slidably movable with respect to the housing, the push rod having first and second ends, the first end of the push rod being operable to contact a viscous fluid material dispenser cartridge when a viscous fluid material dispenser cartridge is mounted to the housing for urging discharge of viscous fluid material from the cartridge, said adaptor comprising:

a base plate including means for engaging said means for releasably mounting and an opening for receiving the first end of the dispenser push rod;

a cap member including an opening for receiving a nozzle of said particulate material dispenser cartridge; and means for adjusting the relative positions of said base plate and said cap member.

16. The adaptor of claim 15 wherein said means for adjusting comprise a threaded rod rotatably received in one of said base plate and said cap member and threadably received in the other of said base plate and said cap member.

17. The adaptor of claim 16 wherein said means for adjusting further comprise an alignment rod extending substantially parallel to said threaded rod and carried by one of said base plate and said cap member and received in an opening therefor provided in the other of said base plate and said cap member.

* * * * *